United States Patent [19]

Allen

[11] Patent Number: 4,605,341

[45] Date of Patent: Aug. 12, 1986

[54] MINE ROOF SUPPORT AND ATTACHMENT MEANS THEREFOR

[75] Inventor: Archelaius D. Allen, Preston, England

[73] Assignee: Dobson Park Industries Plc., Nottingham, England

[21] Appl. No.: 663,496

[22] Filed: Oct. 22, 1984

[30] Foreign Application Priority Data

Oct. 22, 1983 [GB] United Kingdom ..... 8328281

[51] Int. Cl.[4] ..... E21D 15/44; E21D 23/08

[52] U.S. Cl. ..... 405/297; 405/299

[58] Field of Search ..... 405/291, 293, 294, 297, 405/299, 300, 301; 299/31, 33

[56] References Cited

U.S. PATENT DOCUMENTS

| | | | |
|---|---|---|---|
| 2,694,293 | 11/1954 | Perrin et al. | 405/299 |
| 3,197,966 | 8/1965 | Arnott | 405/300 X |
| 3,332,246 | 7/1967 | Creuels et al. | 405/300 |
| 3,748,861 | 7/1973 | Groetschel | 405/300 X |
| 4,309,130 | 1/1982 | Bemmerl | 405/291 X |
| 4,380,410 | 4/1983 | Bull et al. | 405/299 |

FOREIGN PATENT DOCUMENTS

| | | |
|---|---|---|
| 1137047 | 12/1968 | United Kingdom . |
| 1171944 | 11/1969 | United Kingdom . |
| 1173988 | 12/1969 | United Kingdom . |
| 1179233 | 1/1970 | United Kingdom . |
| 1261118 | 1/1972 | United Kingdom . |
| 1384054 | 2/1975 | United Kingdom . |
| 1414257 | 11/1975 | United Kingdom . |
| 1472552 | 5/1977 | United Kingdom . |
| 1570697 | 7/1980 | United Kingdom . |
| 2060043A | 4/1981 | United Kingdom . |
| 1595879 | 8/1981 | United Kingdom . |
| 2084231A | 4/1982 | United Kingdom . |
| 2108559A | 5/1983 | United Kingdom . |

*Primary Examiner*—David H. Corbin

*Attorney, Agent, or Firm*—Murray and Whisenhunt

[57] ABSTRACT

Attachment means are provided for attaching a mine roof support to an abutment, (e.g. a flexible conveyor) the attachment means comprising a ram arrangement in the form of at least two rams 25, 26 operable to effect relative movement between the mine roof support and the abutment. The provision of two or more rams instead of the conventional single ram means that smaller bore rams may be used, for example a 60 mm bore as opposed to 4¼ inch bore and this makes it possible to cover or encase the rams in a protective shield without reducing the vertical space available to a miner underneath the mine roof support.

16 Claims, 8 Drawing Figures

MINE ROOF SUPPORT AND ATTACHMENT MEANS THEREFOR

BACKGROUND TO THE INVENTION

The invention relates to mine roof supports.

DESCRIPTION OF THE PRIOR ART

Mine roof supports are well known comprising a base unit and a mine roof engaging canopy interconnected by upwardly extending legs, usually in the form of hydraulic rams. In use a row of adjacent supports extends along a mine face, a flexible conveyor lying between the row of supports and the face. Each support is connected to the conveyor by a substantially horizontal ram.

As a cutting machine moves along the face to cut away a web of mineral and deposit it on the conveyor, each support is in turn used to push the flexible conveyor forward to the newly cut face by extending or retracting its horizontal ram. Each support is then freed from the roof by retracting its legs, is drawn forward to a new position by retracting or extending its horizontal ram, and is re-set to the roof in its new position adjacent the re-aligned conveyor by extending the legs.

Sometimes it is necessary to connect the piston of the horizontal ram to the conveyor by an articulated joint means including an extension piece known as a relay bar.

Problems arise from the fact that miners have to walk or crawl over the horizontal rams or relay bars attached thereto as they move along the face under the canopies of the support. It is not unknown for a miner to have his foot caught and dragged under a fixed part of a support by the horizontal ram or its relay bar, as it moves relative to the support, e.g. under the influence of other horizontal rams, on supports some five or six supports away and out of sight of an operator controlling such rams.

In an attempt to solve this problem guards are positioned over the horizontal rams but this reduces the vertical space available to a miner as he moves under the supports and has been found to be a particularly unsatisfactory solution in thin seam mines.

The provision of guards may also prevent the 'flow' of loose material through the support base as it is drawn forward and a gradual build up of this material may restrict movement and cause mechanical damage to the horizontal ram and adjacent parts of the support.

We have now discovered that it is possible to provide a ram arrangement which takes up less space in the vertical direction than known ram arrangements, thus making it possible to reduce or eliminate the problems.

SUMMARY OF THE INVENTION

Accordingly the invention provides means for attaching a mine roof support to an abutment such as a flexible conveyor, the mine roof support having a base unit, a mine roof engaging canopy, and support means separating the base unit and canopy thus providing a miners walkway between the base unit and the canopy, the attachment means comprising a ram arrangement in the form of at least two rams operable to effect relative movement between the mine roof support and the abutment, means for extending and retracting the rams in unison, and a protective structure, the rams being positioned side by side under the protective structure such that in use the protective structure provides a platform in the walkway and miners can walk or crawl over, or sit on, the protective structure, there being no dangerous movement of the protective structure in the longitudinal direction within the confines of the walkway.

The somewhat unusual step of utilising two or more rams instead of the conventional single ram means that smaller bore rams may be used, for example of 60 mm bore as opposed to $4\frac{1}{4}$ inch bore. This makes it possible to cover or encase the rams in a protective shield without reducing the vertical space available to a miner, and to provide a safer passage through, and a safer location in, the row of supports.

The protective structure preferably comprises a housing from within which the rams operate.

The protective structure may have means for pivotally mounting it at one end to the support.

The housing may comprise a double-barrelled sheath for the rams.

The rams, including any relay bar attached thereto may be guided in the protective structure during at least part of their travel.

At least one ram may be used for extension purposes.

At least one ram may be used for retraction purposes.

At least one and preferably all the rams are double-acting.

The piston rods of the rams may be fixed with respect to the housing, the cylinders of the rams being slidable in the housing.

The means for extending and retracting the rams in unison may include a common inlet to the rams for pressurised fluid and a common outlet.

There may be passages through the piston rods of the rams to carry pressurised fluid.

The said passages may be interconnected by a common manifold block.

The free ends of the cylinders may be linked by a common attachment.

The invention includes a mine roof support having attachment means as defined above.

Preferably the side to side rams are positioned centrally of the base unit of the support.

The base unit may comprise a pair of skids and the rams may be positioned between the skids.

The front (i.e. leading) end of the skids may be interconnected by a bridge which extends over the rams.

The mine roof support may be provided with means to lift the front (i.e. leading) end of the base of the support to facilitate movement of the support over debris or over steps left by the cutting machine.

Preferably the lifting means comprises a ram attached to a part of the support and arrangeable to press down on the said ram arrangement, thus raising the base of the support relative to the ram arrangement.

Preferably the protective structure is level with or lower than the upper surface of the skids.

The roof support preferably has legs forward and rearward of the miners walkway, the protective structure lying between these forward and rear legs.

Preferably at least one of the rams of the ram arrangement has a striker valve device, i.e. a valve device which is actuated by being struck when the ram has extended or retracted by a predetermined amount. The striker valve device may be internal or external.

Other objects and advantages of the invention will become apparent from the following description of embodiments of the invention given by way of example.

DETAILED DESCRIPTION OF THE EMBODIMENTS

Figure 1:
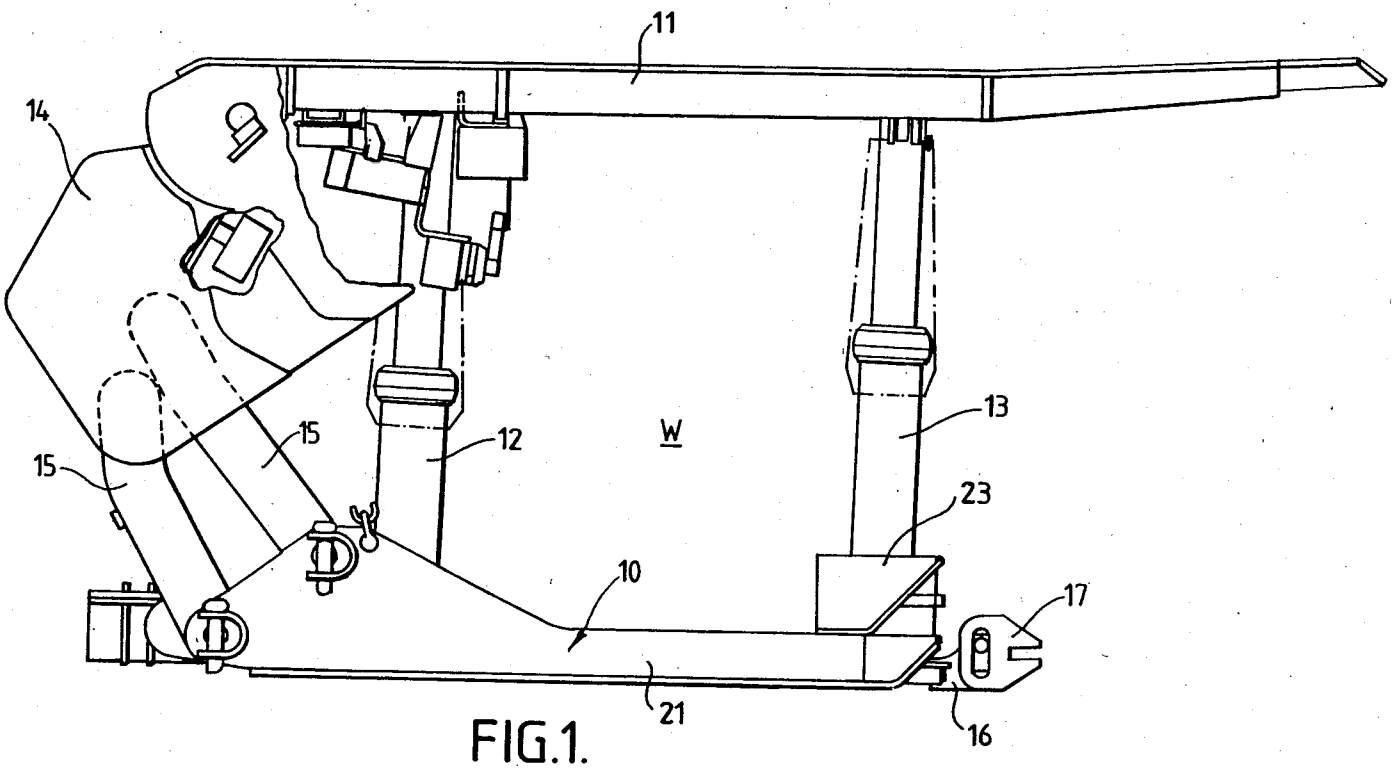
FIG. 1 is a side view of an embodiment of mine roof support according to the invention.

The mine roof support forming the subject of this embodiment has, as best shown in FIG. 1, a base unit 10 and a roof engaging unit 11 interconnected by two rear legs 12 and one front leg 13 each leg being in the form of a hydraulic jack. The base unit 10 and roof engaging unit 11 are also interconnected by a shield portion 14 and links 15 in a conventional manner which need not be described further. The invention is concerned with the horizontal ram arrangement by means of which the roof support is connected, in use, to the flexible conveyor extending along a mine face. The front end 16 of the ram arrangement is visible in FIG. 1, and attached to front end is a bracket 17 for connection to the conveyor (not shown).

Figure 2:
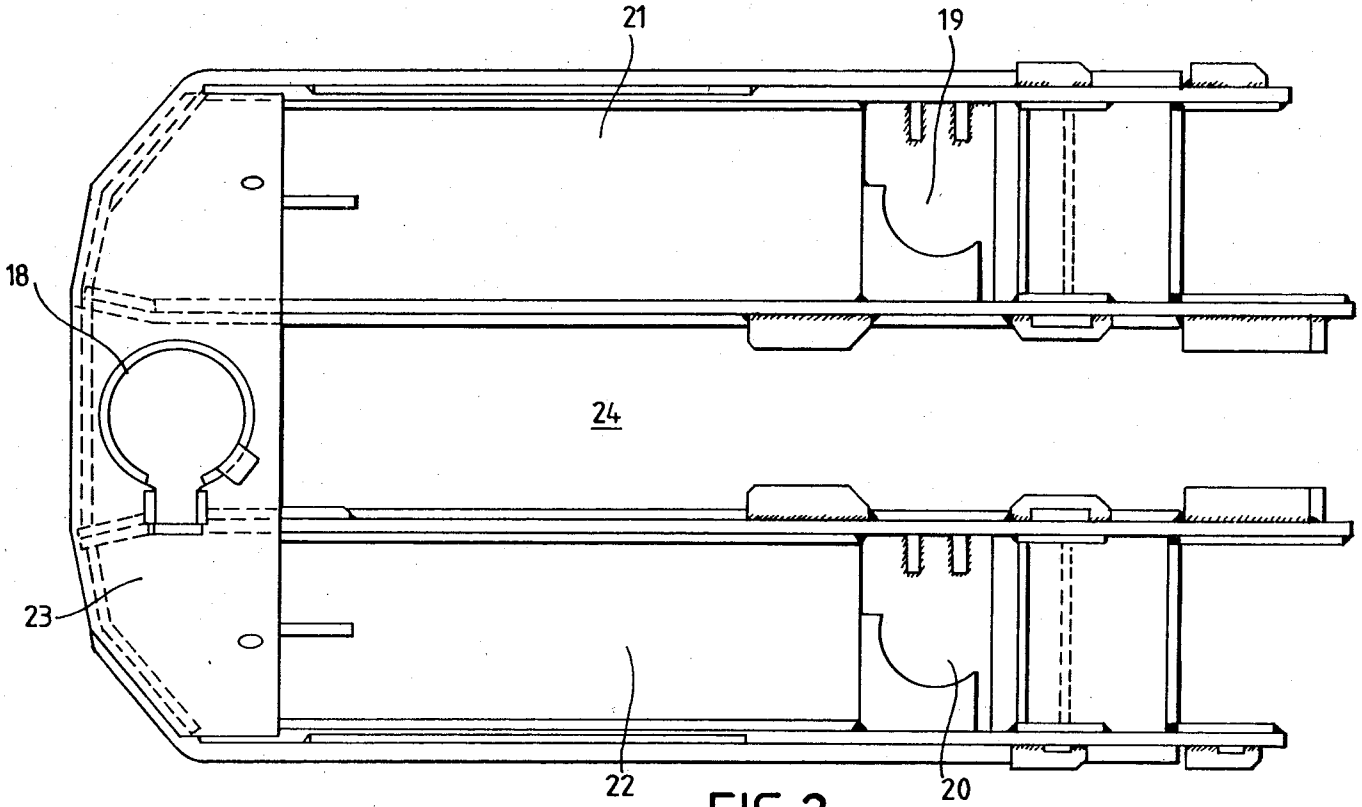
FIG. 2 is a plan view of the base unit of the support shown in FIG. 1, with the horizontal ram arrangement omitted.
Figure 3:
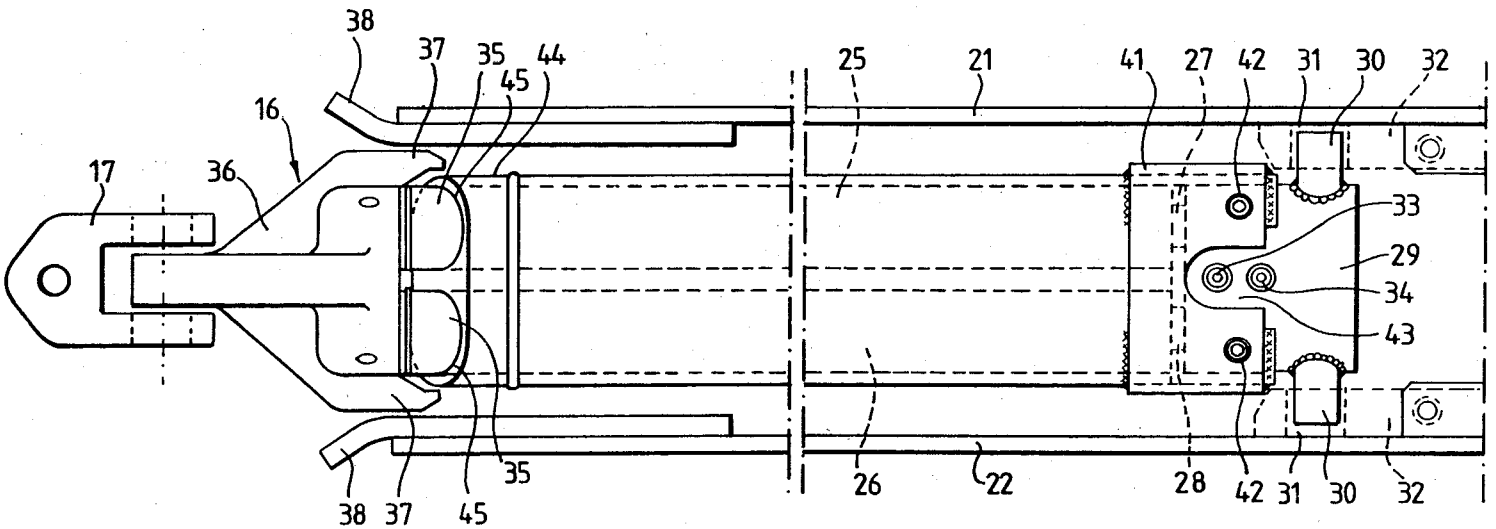
FIG. 3 is a plan view of the ram arrangement, shown attached to part of the base unit.

The positions of the legs 12 and 13 can be visualised in plan view from FIG. 2. Although the legs are not shown in FIG. 2, the front leg 13 is positioned at 18 and the rear legs 12 are positioned at 19 and 20. It will be seen from FIG. 2 that the base unit comprises a pair of skids 21 and 22 interconnected by a bridge unit 23. The ram arrangement occupies the space 24 which lies between the skids 21 and 22 and between the leg positions 18 and 19, 20.

It will be seen from FIG. 1 that the ram arrangement passes underneath the bridge unit 23. The space through which a miner has to walk (or, in the case of thin seams, crawl) is the space indicated by the reference letter W, known as the walkway. It will be appreciated that the miner has to walk or crawl over the ram arrangement and problems have arisen when a miner is working in the walkway from a miner's foot being caught by an extending ram and dragged underneath the bridge unit 23. The invention seeks to remove or alleviate this problem by ensuring that the parts on which a miner walks, crawls, works or rests, do not move with respect to the base unit but at the same time are not of such a height as to reduce the vertical space available in the walkway W.

The ram arrangement according to this invention comprises a pair of horizontal rams arranged side by side, instead of the conventional single ram. The rams comprise cylinders 25 and 26 and piston rods 27 and 28. The piston rods 27 and 28 are attached to a common connector block 29 which is pivotally mounted between the skids 21 and 22 by means of stub axles 30 which fit into sockets 31 in brackets 32 bolted to the skids. The stub axles 30 fit into the sockets 31 with a significant clearance to allow the front end 16 of the ram arrangement limited sideways movement with respect to the skids.

The block 29 has a feed port 33 and an exhaust port 34 to which hydraulic fluid supply hoses are connected in use. The fluid is fed to the cylinders 25 by passages (not shown) which extend through the block 29 and through the interior of the piston rods 27 and 28.

The front (i.e. leading) ends 35 of the cylinders 25 and 26 are welded to a bracket 36 which comprises the leading end 16 of the ram arrangement and is pivotally connected to the conveyor connection bracket 17. The bracket 36 has shaped side pieces 37 which, when the rams are retracted, co-operate with flared portions 38 of the skids in such a way as to centralise the ram arrangement relative to the skids if the ram arrangement should have moved out of alignment with the skids while the ram arrangement was extended, as often happens as the conveyor and mine roof support move over the difficult terrain of a mine floor.

The stationary portion which is provided for the miners to walk and crawl over is provided by a protective structure in the form of a sheath 39. The sheath is generally oval in cross-section and surrounds both cylinders 25, 26. The sheath 39 has a trailing end portion 41 welded thereto which is secured by means of Allen screws 42 to the connector block 29. The portion 41 is cut away at 43 to permit access to the feed and exhaust ports 33, 34.

Thus the sheath 39 cannot move in the longitudinal direction with respect to the skids 21 and 22 and hence provides a safe structure for miners to work and walk on or crawl over as they move through the walkway.

To provide some guidance for the cylinders 25 and 26, the sheath 39 has welded to the leading end thereof a mouthpiece 44 which has a pair of bores 45 therethrough and each of the cylinders is a close sliding fit within one of the bores.

To facilitate forward movement of the mine roof support over debris or steps left in the mine floor by the cutting machine, it is desirable to be able to raise the leading ends of the skids 21 and 22.

Figure 4:
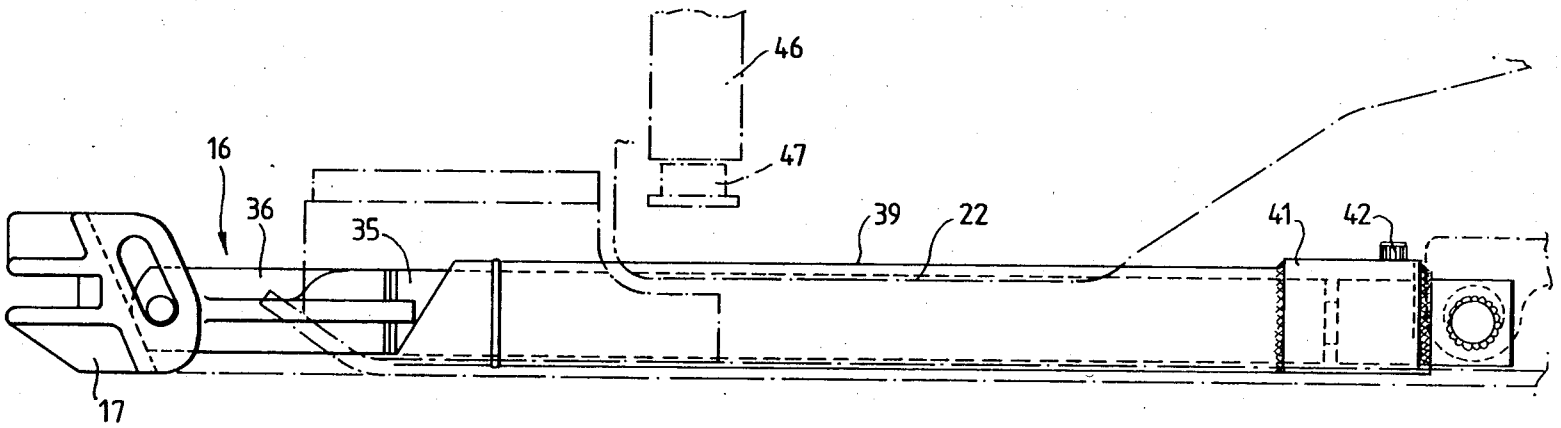
FIG. 4 is a side view of the ram arrangement.
Figure 5:
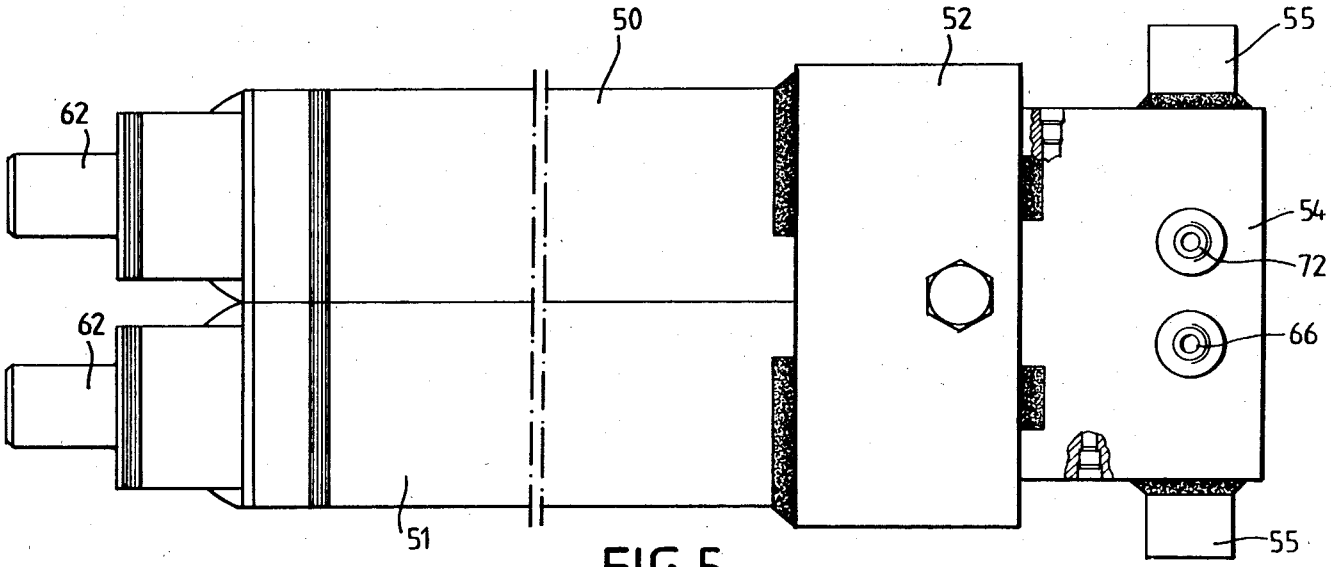
FIG. 5 is a plan view of an alternative embodiment of attachment device according to the invention.
Figure 6:
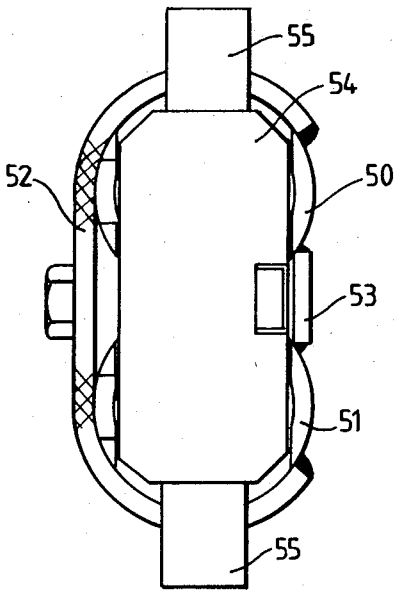
FIG. 6 is an end view of the device shown in FIG. 5.
Figure 7:
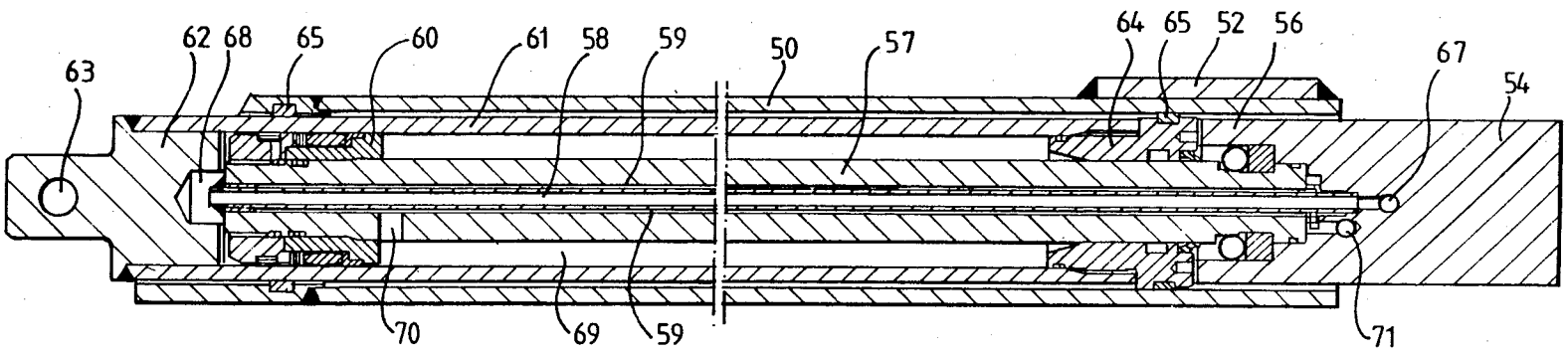
FIG. 7 is a cross-sectional view on line VII—VII of FIG. 5.

To provide this base lift facility a further upwardly extending ram 46 is provided (see FIG. 4). The piston rod of the ram is provided with a foot in the form of a pressure pad 47. The upper end of the ram 46 is secured to an upper portion of the roof support base. When the ram 46 is extended the pressure pad 47 bears down on the upper face of the sheath 39. Since the ram arrangement, which is pivotally mounted at its trailing end for the skids, is lying on the mine floor and cannot move downwardly, the upper end of the ram 46 rises, lifting the leading ends of the skids 21 and 22 with it.

Because the sheath 39 has a substantially flat upper face, this provides an excellent bearing surface for the pressure pad 47, unlike the situation with a conventional single ram which presents a cylindrical surface. It also provides a static surface compared with the sliding of conventional systems.

As can be best seen from FIG. 4, the use of two small bore rams enables the ram arrangement, together with its sheath 39, to project only very slightly above the level of the skids 21 and 22, thus leaving the vertical space available in the walkway substantially unaltered.

Turning now to FIGS. 5 to 8, the embodiment shown in these Figures is identical in principle to that shown in FIGS. 1 to 4, but differs in some aspects of detail. The housing for the rams comprises a pair of cylindrical sleeves 50, 51 welded together. A band of metal 52 covers the top and outer sides of the sleeves 50 and 51, at the rear end of the sleeves, and a plate 53 is welded to the undersides of the sleeves. A common manifold block 54 has a pair of plug portions, one of which can be seen at 56 in FIG. 7, which fit respectively into the rear ends of the sleeves. The manifold block 54 carries a pair of pivot pins 55 for use in pivotally mounting the ram device on a mine roof support.

Secured to each plug portion 56 of the manifold block 54 there is a piston rod 57. The piston rod has a central bore 58 and also a concentric annular passage 59, extending throughout the length of the piston rod.

The piston rod has a piston head 60 secured thereto and the head 60 is in sealing engagement with the inner surface of a cylinder 61 of the associated ram. The leading end of the cylinder 61 is sealed by an end cap 62 welded thereto, and each end cap 62 has a horizontal hole 63 therethrough. The trailing end of each cylinder is closed by an end plug 64 which seals against the associated piston rod 57. Each cylinder is guided for movement within the associated sleeve 50 by bearing rings 65.

When it is desired to extend the rams hydraulic fluid is fed to a common port 66 in the manifold block 54. Hydraulic fluid entering this port 66 is supplied by a cross drilling 67 to the central passage 58 of each piston rod. Hydraulic fluid thus travels to the lefthand end of the piston rod as viewed in FIG. 7 to a chamber 68 within each cylinder end cap 62. Each cylinder is thus forced to the left as viewed in FIG. 7.

As each cylinder extends, fluid lying within the annular chamber 69 between the piston head 60 and the end plug 64 is exhausted by travelling through a radial port 70 in the piston rod, along the annular passage 59, and out through a cross drilling 71 to an outlet port 72.

To retract the rams, fluid is applied to port 72 and the fluid within the cylinder is allowed to exhaust through port 66.

Figure 8:
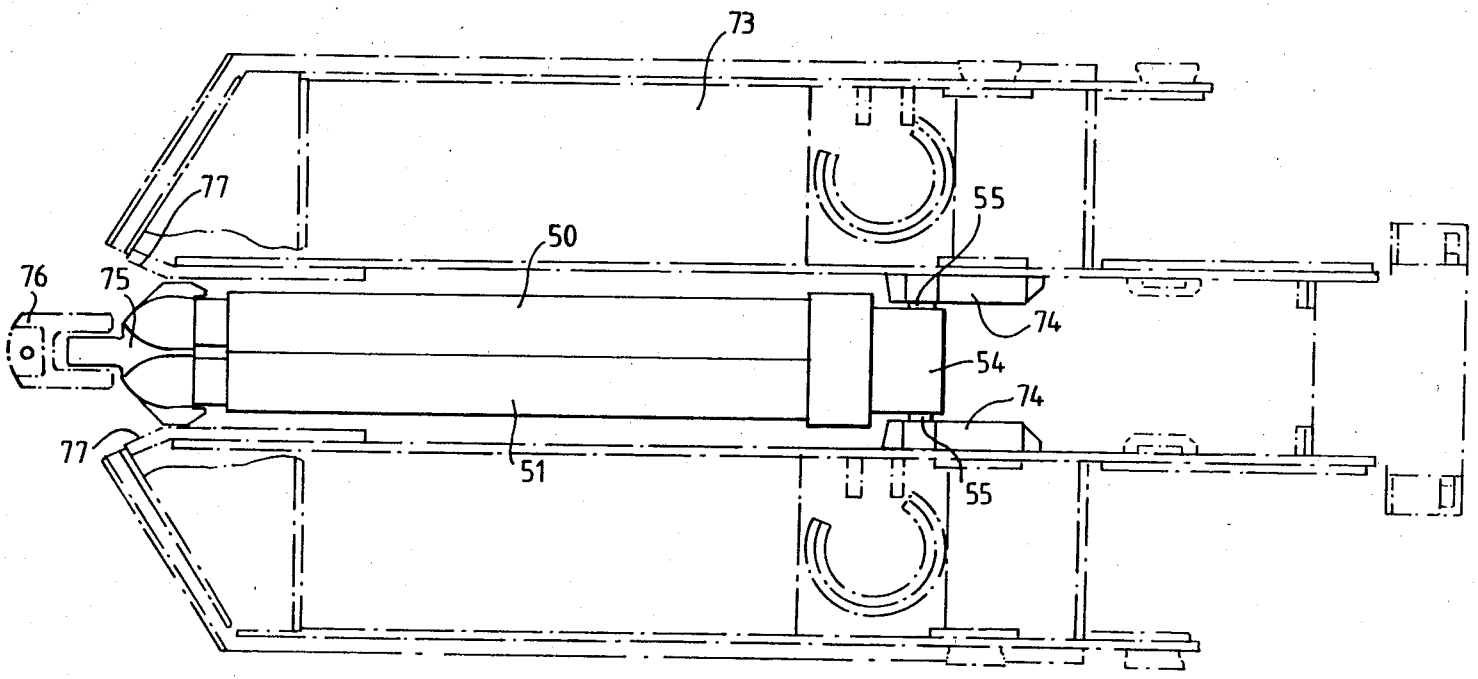
Fig. 8 is a plan view of the attachment device of FIG. 5, showing how it is positioned on a mine roof support in use.

In use, the ram arrangement is secured between a pair of skids 73 of an underground mine roof support, by fitting the pivot pins 55 into appropriate bearings 74, as shown in FIG. 8.

The two cylinder end caps 62 are secured together by a common bracket 75 by passing pins through the holes 63, and the common bracket 75 is connected to a coupling 76 for use in attaching the rams to a flexible conveyor. The mine roof support itself is generally similar to that shown in FIGS. 1 and 2 and will not be described further in detail. However it will be noted that the skids 73 are angled at 77 to provide a flared mouth which guides the common bracket 75 to a central position as the rams are retracted.

The vertical relationship between the rams and the skids is substantially identical to that shown in FIG. 4. In other words the upper surface of the rams is level with or below the upper surface of the skids.

The invention is not restricted to the details of the foregoing embodiments. For example the shape and configuration of the sheath 39 may be different, and the sheath may for example be of rectangular cross-section.

Similarly, the arrangement of the rams 25 and 26 may be different and in particular the rams may be arranged so that the cylinders remain stationary and the piston rods extend.

I claim:

1. A mine roof support suitable for use in thin seam mines, said support comprising:

a base unit having a height;

a mine roof engaging canopy;

support means for separating said base unit and said canopy to provide a miner's walkway having a vertical space between said base unit and said canopy;

attachment means connected to said base unit for attaching the mine roof support to a flexible conveyor, said attachment means including at least two telescopic rams each having a piston and a cylinder, a first common connection means for connecting said cylinders together, and a second common connection means for connecting said pistons together, at least one of said first and second common connection means including fluid flow passages through which hydraulic fluid can be fed simultaneously to each said cylinder, said rams being extended or retracted in unison when fluid is fed to or removed from said cylinders; and a protective structure connected to said base unit, said rams being positioned in side-by-side relationship under said protective structure, said protective structure providing a platform in said walkway which miners can walk or crawl over, or sit on, said attachment means and said protective structure not extending substantially above said height of said base unit, thereby leaving said vertical space available in said walkway substantially unaltered.

2. A mine roof support as claimed in claim 1, in which said protective structure comprises a housing from within which said rams operate.

3. A mine roof support as claimed in claim 2, in which said protective structure has means for pivotally mounting it at one end of said support.

4. A mine roof support as claimed in claim 2, in which said housing comprises a double barrelled sheath for said rams.

5. A mine roof support as claimed in claim 1, in which said rams are guided in said protective structure during at least part of their travel.

6. A mine roof support as claimed in claim 2, in which said pistons are fixed with respect to said housing, and said cylinders are slidable in said housing.

7. A mine roof support as claimed in claim 1, in which there are passages through said pistons for conveying pressurized fluid.

8. A mine roof support as claimed in claim 1, in which at least one of said rams has an internal or external striker valve device which is actuated by being struck when said at least one ram has extended or retracted by a predetermined amount.

9. A mine roof support suitable for use in thin seam mines, said support comprising:

a mine floor engaging base unit having a height;

a mine roof engaging canopy;

support means for separating said base unit and said canopy to provide a miner's walkway having a vertical space between said base and said canopy;

attachment means connected to said base unit for attaching the mine roof support to a flexible conveyor, said attachment means including at least two telescopic rams each having a piston and a cylinder, a first common connection means for connecting said cylinders together, and a second common connection means for connecting said pistons together, at least one of said first and second common connection means including fluid flow passages through which hydraulic fluid can be fed simultaneously to each said cylinder, said rams being extended or retracted in unison when fluid is supplied to or removed from said cylinders, said support being caused to undergo forward movement towards said conveyor when said rams are retracted;

lifting ram means attached to an upper part of the mine roof support above said rams for pressing down on said rams to raise the rest of said support with respect to said rams and hence assist said support in riding over mine floor debris during said forward movement of said support; and a protective structure connected to said base unit, said rams being positioned in side-by-side relationship under said protective structure, said protective structure providing a platform in said walkway which miners can walk or crawl over, or sit on, said attachment means and said protective structure not extending substantially above said height of said base unit, thereby leaving said vertical space available in said walkway substantially unaltered.

10. A mine roof support as claimed in claim 9, in which said protective structure comprises a housing from within which said rams operate.

11. A mine roof support as claimed in claim 10, in which said protective structure has means for pivotally mounting it at one end of said support.

12. A mine roof support as claimed in claim 10, in which said housing comprises a double barrelled sheath for said rams.

13. A mine roof support as claimed in claim 9, in which rams are guided in said protective structure during at least part of their travel.

14. A mine roof support as claimed in claim 10, in which said pistons are fixed with respect to said housing, and said cylinders are slidable in said housing.

15. A mine roof support as claimed in claim 9, in which there are passages through said pistons for conveying pressurized fluid.

16. A mine roof support as claimed in claim 9, in which at least one of said rams has an internal or external striker valve device which is actuated by being struck when said at least one ram has extended or retracted by a predetermined amount.

* * * * *